US010376115B2

(12) United States Patent
Han et al.

(10) Patent No.: US 10,376,115 B2
(45) Date of Patent: Aug. 13, 2019

(54) CYCLONE DUST COLLECTOR AND VACUUM CLEANER INCLUDING THE SAME

(71) Applicant: Samsung Electronics Co., Ltd., Suwon-si (KR)

(72) Inventors: Jung Gyun Han, Suwon-si (KR); Shin Kim, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 582 days.

(21) Appl. No.: 14/993,611

(22) Filed: Jan. 12, 2016

(65) Prior Publication Data

US 2016/0287042 A1 Oct. 6, 2016

(30) Foreign Application Priority Data

Mar. 31, 2015 (KR) ..... 10-2015-0045790

(51) Int. Cl.
*A47L 9/16* (2006.01)
*A47L 9/20* (2006.01)

(52) U.S. Cl.
CPC ..... *A47L 9/1683* (2013.01); *A47L 9/20* (2013.01)

(58) Field of Classification Search
CPC ..... A47L 9/20; A47L 9/1683
USPC ..... 15/352
See application file for complete search history.

(56) References Cited

U.S. PATENT DOCUMENTS

2004/0187253 A1 9/2004 Jin et al.
2004/0200029 A1* 10/2004 Jin ..... A47L 9/1675 15/352
2011/0016659 A1 1/2011 Dyson et al.
2012/0000029 A1 1/2012 Nicolaou et al.
2014/0020206 A1 1/2014 Moloney et al.
2014/0090563 A1 4/2014 Robertson et al.
2014/0137363 A1 5/2014 Wilson

FOREIGN PATENT DOCUMENTS

EP 1136028 9/2001
GB 2388307 11/2003
KR 10-2005-0091836 9/2005
KR 10-0840889 6/2008

OTHER PUBLICATIONS

European Communication dated Mar. 21, 2019 in European Patent Application No. 16156861.3.

* cited by examiner

*Primary Examiner* — David Redding
(74) *Attorney, Agent, or Firm* — Staas & Halsey LLP

(57) ABSTRACT

Disclosed herein are a cyclone dust collector configured to easily remove dust, hairs, etc. which stick to an outer circumferential surface of a grill portion while the grill portion is being separated and a vacuum cleaner including the cyclone dust collector. The vacuum cleaner includes a cyclone dust collector. The cyclone dust collector includes a case in which dust in sucked air is separated and accommodated, a grill assembly separably mounted on the case, and a cleaning portion configured to clean a surface of the grill assembly.

29 Claims, 16 Drawing Sheets

CYCLONE DUST COLLECTOR AND VACUUM CLEANER INCLUDING THE SAME

CROSS-REFERENCE TO RELATED APPLICATIONS

This application claims the priority benefit of Korean Patent Application No. 10-2015-0045790, filed on Mar. 31, 2015 in the Korean Intellectual Property Office, the disclosure of which is incorporated herein by reference.

BACKGROUND

1. Field

The following description relates to a cyclone dust collector having improved usability and a vacuum cleaner having the cyclone dust collector.

2. Description of the Related Art

Vacuum cleaners are apparatuses which suction air using suction force generated by a fan and a motor, and allow foreign substances included in the suctioned air to be filtered out to perform cleaning.

Vacuum cleaners each include a dust collecting unit therein to filter foreign substances in the suctioned air using a filtering device to filter out foreign substances. For the filtering device to filter foreign substances in the dust collecting unit, there are porous filter units through which air passes to forcibly filter out foreign substances and cyclone type dust collecting units to allow foreign substances to be filtered out during a cyclone flow of air.

Cyclone dust collectors may be generally used for canister type cleaners, upright type cleaners, and hand type cleaners.

Cyclone dust collectors each may include an inlet portion through which air flows in and an outlet portion through which the air flows out. The air which flows in through the inlet portion may be filtered to collect dust and may be discharged through the outlet portion.

The outlet portion of each cyclone dust collector may include a grill portion. The grill portion includes air through holes not to allow dust having a predetermined size or more to pass through the outlet portion. Dust having a large size and hairs may be collected on an outer circumferential surface of the grill portion due to circling air of the cyclone dust collector. In the case of conventional cyclone dust collectors, it is inconvenient for a user to remove dust and hairs collected on the outer circumferential surface by hand.

SUMMARY

Therefore, it is an aspect of the present disclosure to provide a cyclone dust collector configured to easily remove dust, hairs, etc. which stick to an outer circumferential surface of a grill portion while the grill portion is being separated and a vacuum cleaner including the cyclone dust collector.

Additional aspects of the disclosure will be set forth in part in the description which follows and, in part, will be obvious from the description, or may be learned by practice of the disclosure.

In accordance with an aspect of the present disclosure, a vacuum cleaner includes a cyclone dust collector. Herein, the cyclone dust collector includes a case in which dust in sucked air is separated and accommodated, a grill assembly separably mounted on the case, and a cleaning portion configured to clean a surface of the grill assembly.

The cleaning portion may disturb dust which sticks to the surface of the grill assembly while the grill assembly is being separated from the case.

The cleaning portion may be configured to rub the surface of the grill assembly.

The cleaning portion may be integrally provided together with the case.

The case may include an opening in one side of the case, and the grill assembly may be configured to be insertable into the case through the opening.

The cleaning portion may be provided on an inner wall of the case in which the opening is formed.

A diameter of the opening may be identical to a diameter of the grill assembly inserted in the case.

The cleaning portion may include an interfering protrusion which protrudes from an inner wall of the case.

The grill assembly may include a grill portion which includes air through holes formed therein and is able to be accommodated in the case and a handle portion provided on one side of the grill portion.

The grill portion may include a supporting rib configured therein to support the grill portion.

The cyclone dust collector may further include a cover which covers one side of the case.

The case may include a coupling protrusion on an outer surface thereof.

The handle portion may include an interfering portion configured to interfere with the coupling protrusion.

The handle portion may include an insertion hole into which the coupling protrusion is insertable.

When the interfering portion is inserted into the insertion hole and the handle portion is rotated in one direction, the coupling protrusion may be disturbed by the interfering protrusion and the handle portion may be fixed to the case.

The handle portion may include an uneven portion on a surface thereof.

The grill portion and the handle portion may be integrally injection-molded.

In accordance with an aspect of the present disclosure, a cyclone dust collector includes a case in which dust in sucked air is separated and accommodated and a grill portion separably mounted on the case. Herein, dust which sticks to a surface of the grill portion is removed when the grill portion is separated from the case.

The case may include a cleaning portion which removes the dust which sticks to the surface of the grill portion.

The cleaning portion may disturb the dust which sticks to the surface of the grill portion to leave the dust in the case.

The cleaning portion may be integrally formed together with the case.

The case may include an opening to allow the grill portion to pass therethrough.

The cleaning portion may be provided on an inner side surface of the case in which the opening is formed.

A diameter of the opening may be identical to a diameter of the grill portion.

The grill portion may include a handle portion on one side thereof.

The case may include a cover mounted thereon and configured to include an inlet portion configured to allow the sucked air to flow into the case and an outlet portion configured to allow air filtered with dust to be discharged from the case.

The cover may be configured to be openable.

The grill portion may be configured to extend from a bottom surface of the case to the cover.

In accordance with an aspect of the present disclosure, a cyclone dust collector includes a case which separates dust from air which flows in through an inlet portion by allowing the air to circle, an outlet portion configured to allow the air separated from the dust to be discharged from the case, a grill assembly connected to the outlet portion and separably mounted on the case, and a cleaning member which disturbs and removes dust which sticks to a surface of the grill assembly while the grill assembly is being separated from the cyclone chamber.

The case may include an opening to allow the grill assembly to pass therethrough.

The cleaning member may be formed on an inner side surface of the case in which the opening is formed.

The cleaning member may be configured to protrude from the case toward the opening.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
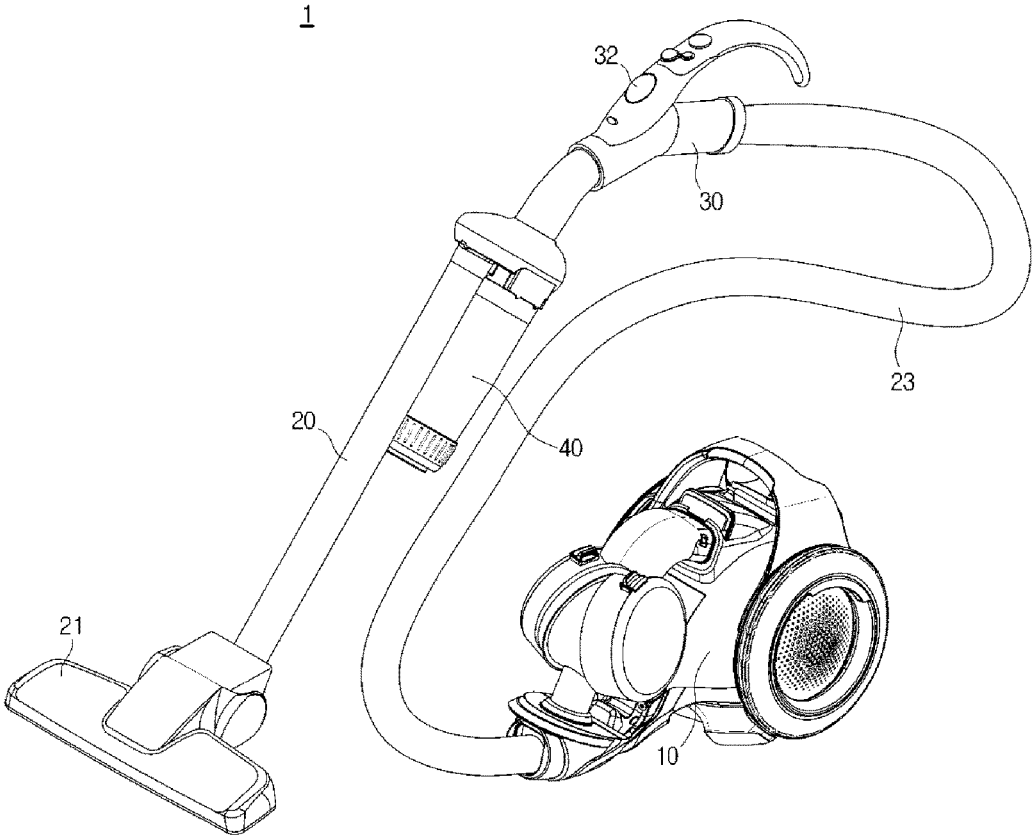
FIG. 1 is a perspective view of a vacuum cleaner in accordance with an embodiment of the present disclosure.

Reference will now be made in detail to the embodiments of the present disclosure, examples of which are illustrated in the accompanying drawings, wherein like reference numerals refer to like elements throughout.

Hereinafter, a cyclone dust collector and a vacuum cleaner including the same in accordance with an embodiment of the present disclosure will be described in detail with reference to the attached drawings.

Figure 2:
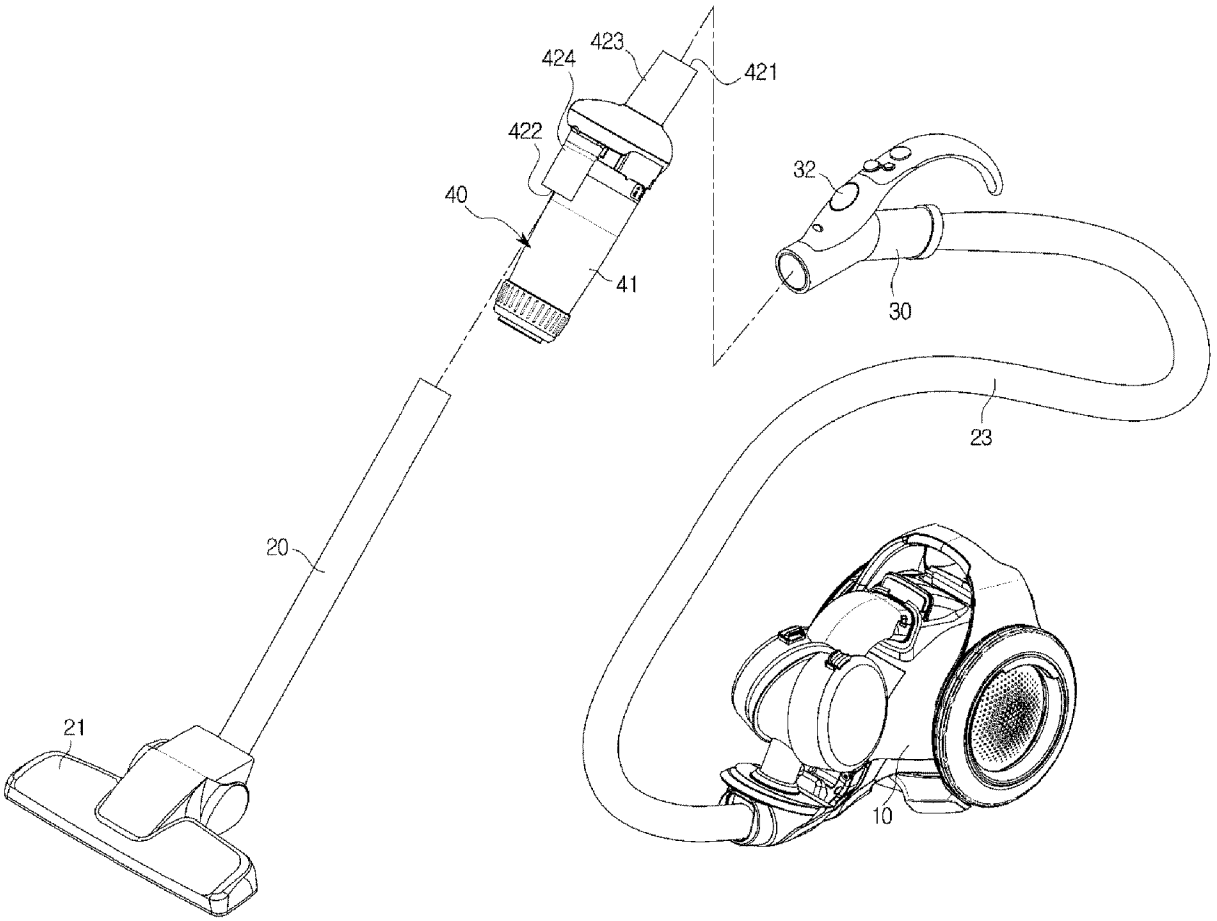
FIG. 2 is a view of a separated cyclone dust collector in accordance with an embodiment of the present disclosure.

FIG. 1 is a perspective view of a vacuum cleaner 1 in accordance with an embodiment of the present disclosure. FIG. 2 is a view of a separated cyclone dust collector 40 in accordance with an embodiment of the present disclosure.

Referring to FIGS. 1 and 2, the vacuum cleaner 1 in accordance with an embodiment of the present disclosure may be a canister type. The vacuum cleaner 1 may include a body 10 which generates a suction force, a suction portion 21 which is in contact with a cleaning-target surface and suctions air, an extension pipe 20 which is connected to the suction portion 21, and the cyclone dust collector 40 which is mounted on the extension pipe 20. The cyclone dust collector 40 may generate a spiral air current and may separate air from dust using centrifugal force.

The body 10 includes a fan motor (not shown) which generates suction force. The suction portion 21 may suction air around a cleaning-target surface and dust included in the air due to the suction force generated by the body 10. The suction portion 21 may have a slightly flat shape to be closely attached to a cleaning-target surface.

The extension pipe 20 may be formed of a resin or a metal, and a handle pipe 30 for allowing a user to operate, and a flexible hose 23 having a flexible material to freely move the handle pipe 30 may be provided. The handle pipe 30 may include an operation portion 32 to operate a function of the vacuum cleaner 1. The cyclone dust collector 40 may be coupled between the extension pipe 20 and the handle pipe 30.

The suction portion 21, the extension pipe 20, the cyclone dust collector 40, the handle pipe 30, and the flexible hose 23 may be all connected with one another. The air sucked inside through the suction portion 21 flows into the cyclone dust collector 40 through the extension pipe 20. The cyclone dust collector 40 may generate a spiral air current and may primarily separate and collect dust using centrifugal force. The air purified by the cyclone dust collector 40 may sequentially pass through the handle pipe 30 and the flexible hose 23 and may flow to the body 10.

The cyclone dust collector 40 may include an inlet 422 into which the air sucked through the suction portion 21 flows and an outlet 421 through which the air purified by the cyclone dust collector 40 is discharged. The extension pipe 20 may be connected to the inlet 422, and the flexible hose 23 may be connected to the outlet 421. The outlet 421 may be connected to a fan motor chamber (not shown) in which the fan motor is provided.

The cyclone dust collector 40 is provided between the extension pipe 20 and the handle pipe 30, thereby separating and collecting dust before the air flows into the body 10.

Figure 3:
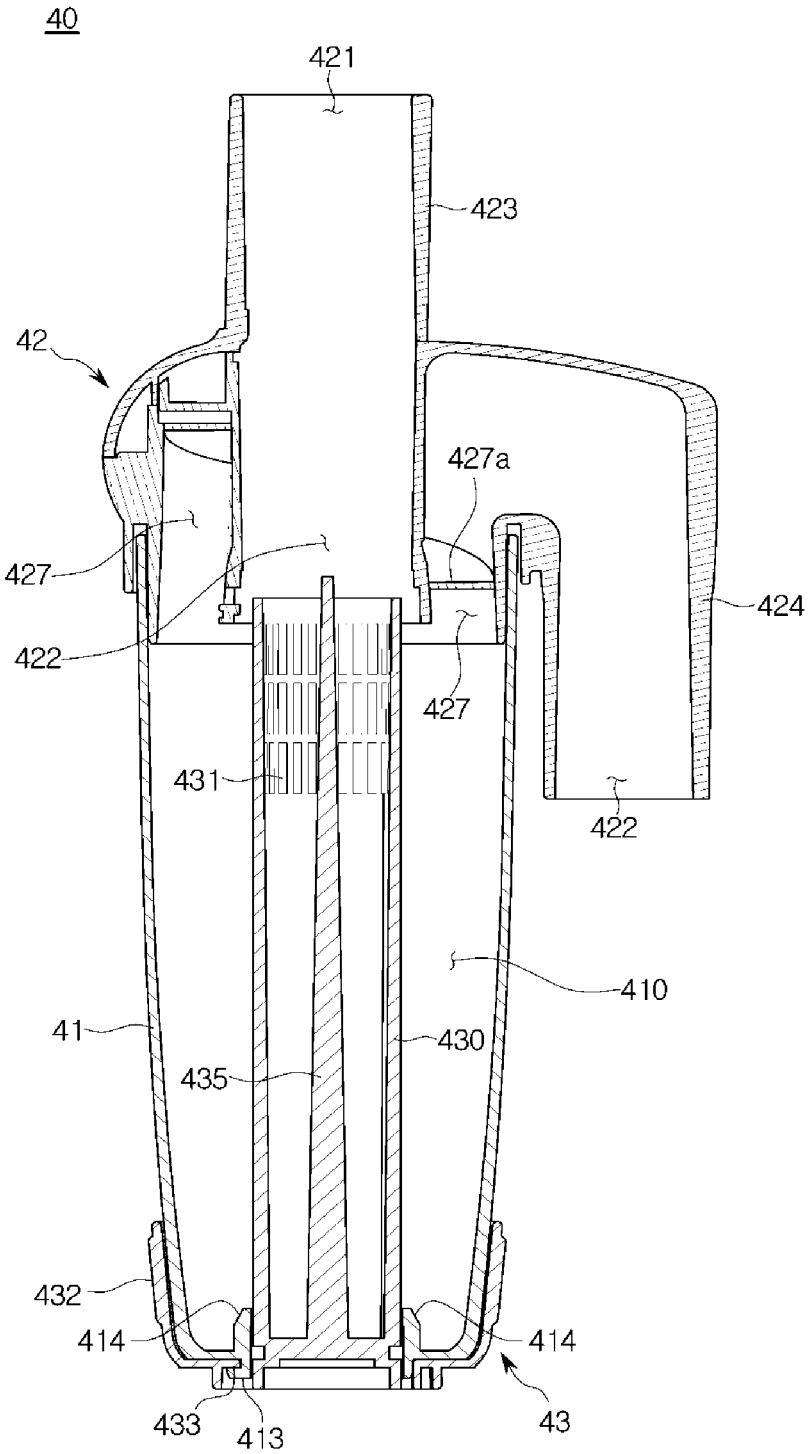
FIG. 3 is a cross-sectional view of the cyclone dust collector in accordance with an embodiment of the present disclosure.
Figure 4:
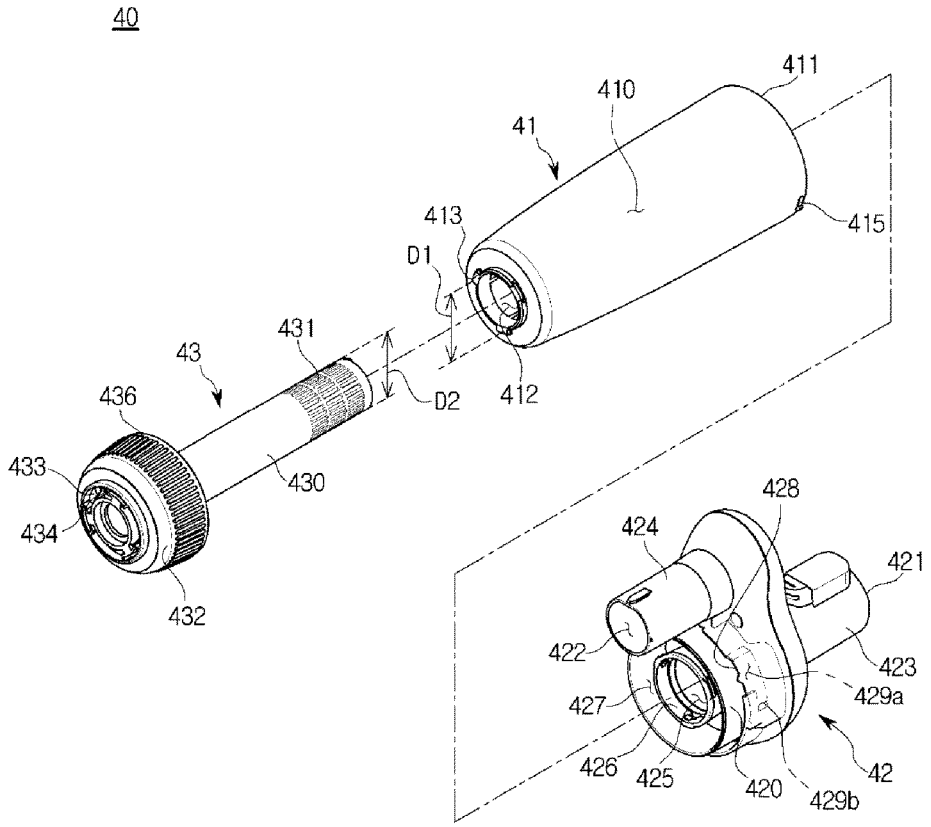
FIG. 4 is an exploded view of a case and a grill assembly of the cyclone dust collector in accordance with an embodiment of the present disclosure.

FIG. 3 is a cross-sectional view of the cyclone dust collector 40 in accordance with an embodiment of the present disclosure. FIG. 4 is an exploded view of a case 41 and a grill assembly 43 of the cyclone dust collector 40 in accordance with an embodiment of the present disclosure.

Referring to FIGS. 3 and 4, the cyclone dust collector 40 in accordance with an embodiment of the present disclosure may include the case 41 which includes a cyclone chamber 410 therein and a cover 42 which closes and opens the case 41. The cyclone dust collector 40 may be connected between the extension pipe 20 and the flexible hose 23 through the case 41.

The case 41 may include the cyclone chamber 410 to allow air which flows therein to circle to separate dust therefrom. For example, the case 41 may have a cylindrical shape including the cyclone chamber 410. The cover 42 may be coupled with one side of the case 41, and the grill assembly 43 may be coupled with the other side thereof. A first opening 411 communicated with the cover 42 may be formed in the one side of the case 41, and a second opening 412 may be formed in the other side of the case 41 to allow at least a part of the grill assembly 43 to be inserted thereinto.

The grill assembly 43 may include a grill portion 430 having air through holes 431 formed therein. The grill portion 430 may be provided in a cylindrical shape. To allow the grill portion 430 to be inserted into the case 41 through the second opening 412, the second opening 412 may have a shape corresponding to an outer surface of the grill portion 430.

A diameter D1 of the second opening 412 may be identical to or slightly greater than a diameter D2 of the grill portion 430 inserted through the second opening 412. The shape of the second opening 412 is not limited thereto. Hereinafter, an example in which the grill portion 430 has a cylindrical shape and the second opening 412 has a circular shape corresponding to the grill portion 430 will be described.

When the grill assembly 43 is separated from the case 41, dust and the like which sticks to a surface of the grill portion 430 may be disturbed by a cleaning portion. For example, an inner side surface of the case 41 forming the second opening 412 may disturb dust and the like. Here, the cleaning portion may be the inner side surface of the case 41 forming the second opening 412. The cleaning portion may be configured to be rubbed by the surface of the grill portion 430.

The dust and the like which sticks the surface of the grill portion 430 may be disturbed by the inner side surface of the case 41 forming the second opening 412, thereby being removed from the surface of the grill portion 430. The dust and the like removed from the surface of the grill portion 430 may not pass through the second opening 412 and may be left in the case 41. The user may throw away the dust left in the case 41. As described above, the user may easily remove the dust and the like which sticks to the surface of the grill portion 430.

The cleaning portion may include an interfering protrusion 414 provided around the second opening 412 to disturb dust which sticks to a surface of the grill assembly 43. The interfering protrusion 414 may protrude inside the case 41. The interfering protrusion 414 may extend from an edge of the second opening 412 in a direction identical to an extension direction of the grill portion 430 inserted through the second opening 412. The interfering protrusion 414 may protrude inside the second opening 412.

When the grill assembly 43 is separated from the case 41 due to the interfering protrusion 414, the dust and the like which sticks to the surface of the grill portion 430 is disturbed and removed from the surface of the grill portion 430. The interfering protrusion 414 may be configured to rub the surface of the grill portion 430. The interfering protrusion 414 may be injection-molded together with the case 41.

A coupling protrusion 413 may be provided around the second opening 412 to allow the grill assembly 43 to be coupled therewith. The coupling protrusion 413 may protrude from an outside of the case 41 around the second opening 412. The coupling protrusion 413 may be provided in plural and may be arranged along a circumferential direction of the second opening 412 while being spaced at predetermined intervals.

The cover 42 may include an extension pipe coupling pipe 424 coupled with the extension pipe 20 to allow air to flow thereinto from the extension pipe 20 and a handle pipe coupling pipe 423 coupled with the handle pipe 30 to allow air from which dust is removed to be discharged toward the handle pipe 30.

The extension pipe coupling pipe 424 may include the inlet 422 formed therein to allow air to flow into the cover 42 through the extension pipe 20. The air which flows into the cover 42 through the inlet 422 may flow into the cyclone chamber 410 through an inlet portion 427.

The handle pipe coupling pipe 423 may include the outlet 421 to allow air to be discharged to the handle pipe 30. The air from which dust is removed while circling in the cyclone chamber 410 may be discharged to the cover 42 through an outlet portion 425. The air discharged through the outlet portion 425 may be discharged through the outlet 421 and may sequentially pass through the handle pipe 30 and the flexible hose 23.

The cover 42 may include a case coupling portion 420 coupled with the case 41. The case coupling portion 420 may have a rib shape which protrudes from a bottom surface of the cover 42 to correspond to the shape of the inner side surface of the case 41. The case coupling portion 420 may have a ring shape corresponding to the shape of the inner side surface of the case 41. The case coupling portion 420 may be provided to be inserted into the case 41.

A fixing protrusion 415 which protrudes may be provided on a side surface of the case 41, and a fixing portion 428 into which the fixing protrusion 415 may be fixedly inserted may be provided on one side of the cover 42. The fixing portion 428 may include a first accommodation portion 429*a* and a second accommodation portion 429*b*. When the case coupling portion 420 is inserted into the case 41, the fixing protrusion 415 may be accommodated in the first accommodation portion 429*a*.

The second accommodation portion 429*b* may be bent and extend from the first accommodation portion 429*a*. After the fixing protrusion 415 is inserted into the first accommodation portion 429*a*, the user may rotate the case 41 in one direction. When the case 41 is rotated in one direction, the fixing protrusion 415 may slide toward the second accommodation portion 429*b*. Due to the fixing protrusion 415 located in the second accommodation portion 429*b*, the case 41 may be coupled with the cover 42.

To open the cover 42, the user may rotate the case 41 in another direction to allow the fixing protrusion 415 to be located in the first accommodation portion 429*a* and then may take the cover 42 apart from the case 41. A method of coupling the case 41 with the cover 42 is not limited thereto.

Inside the case coupling portion 420, a grill coupling portion 426 with which the grill assembly 43 is coupled may be provided being spaced a predetermined interval from the case coupling portion 420. When the case 41 is mounted on the case coupling portion 420, one end of the grill assembly 43 may be fixedly inserted into the grill coupling portion 426. The grill coupling portion 426 and the case coupling portion 420 may be formed to form concentric circles.

Between the case coupling portion 420 and the grill coupling portion 426, the inlet portion 427 through which air flows into the cyclone chamber 410 may be provided. The air which flows into the extension pipe coupling pipe 424 through the inlet 422 may flow into the cyclone chamber 410 through the inlet portion 427. The inlet portion 427 may include a spiral portion 427*a* which slants to have a spiral shape to allow the air which flows into the cyclone chamber 410 to form a spiral air current.

Inside the grill coupling portion 426, the outlet portion 425 through which the air in the cyclone chamber 410 is discharged may be provided. The air from which dust is removed while circling in the cyclone chamber 410 may be discharged from the cyclone chamber 410 through the outlet portion 425. The air discharged from the cyclone chamber 410 may pass through the handle pipe coupling pipe 423, the flexible hose 23, and the fan motor chamber of the body 10, thereby being discharged outside the body 10. The body 10 may further include a filter capable of filtering the air which passes through the cyclone dust collector 40 to collect dust.

The grill assembly 43 may include the grill portion 430 inserted into the case 41 and a handle portion 432 provided on one side of the grill portion 430. The handle portion 432 may be configured to be fixed to the one side of the grill portion 430. A ridged portion 436 may be provided on an outer surface of the handle portion 432 to allow the user to easily operate the assembly.

The grill portion 430 and the handle portion 432 may be injection-molded together. The handle portion 432 and the grill portion 430 may be separately provided and coupled with each other. Hereinafter, an example in which the grill portion 430 and the handle portion 432 are integrally formed will be described.

The grill portion 430 may be inserted into the cyclone chamber 410 and may share a partition with the cyclone chamber 410. The air through holes 431 may be formed in at least a part of the grill portion 430. The air through holes 431 may be formed in a position adjacent to the cover 42 of the grill portion 430.

The air which flows into the cyclone chamber 410 through the inlet portion 427 may form a spiral air current and dust may be separated therefrom due to centrifugal force. The separated dust may be collected between an outer wall of the grill portion 430 and the inner side surface of the case 41. The air separated from the dust may pass through the air through holes 431 and may be discharged through the outlet portion 425. The dust which does not pass through the air through holes 431 may be collected between the outer wall of the grill portion 430 and an inner side surface of the cyclone chamber 410.

Inside the grill portion 430, a supporting rib 435 which extends in the extension direction of the grill portion 430 may be provided. One end of the supporting rib 435 may be fixed to the handle portion 432, and the other end may be fixed to the cover 42. When suction force is generated by the fan motor, the grill portion 430 may be supported by the supporting rib 435 not to move. Also, the air which flows into the grill portion 430 through the air through holes 431 may be guided by the supporting rib 435 to the outlet portion 425.

Figure 5A:
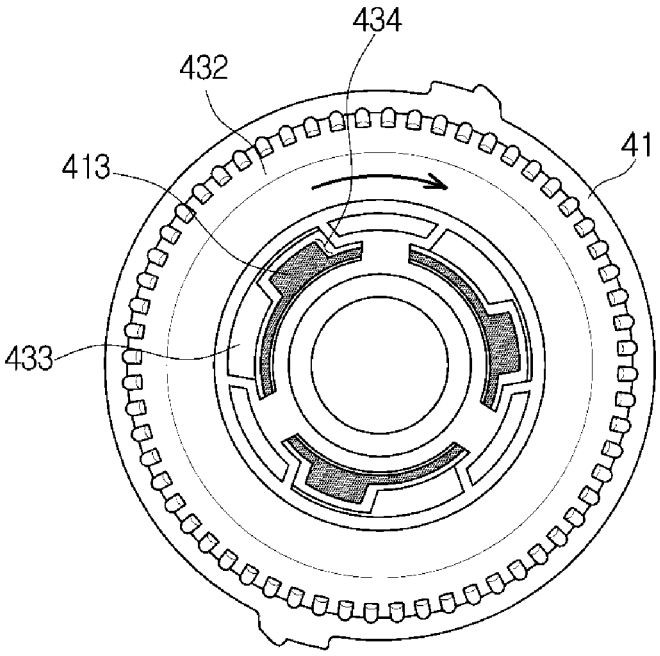
FIGS. 5A and 5B are views of a coupling portion between the grill assembly and the case in accordance with an embodiment of the present disclosure.
Figure 5B:
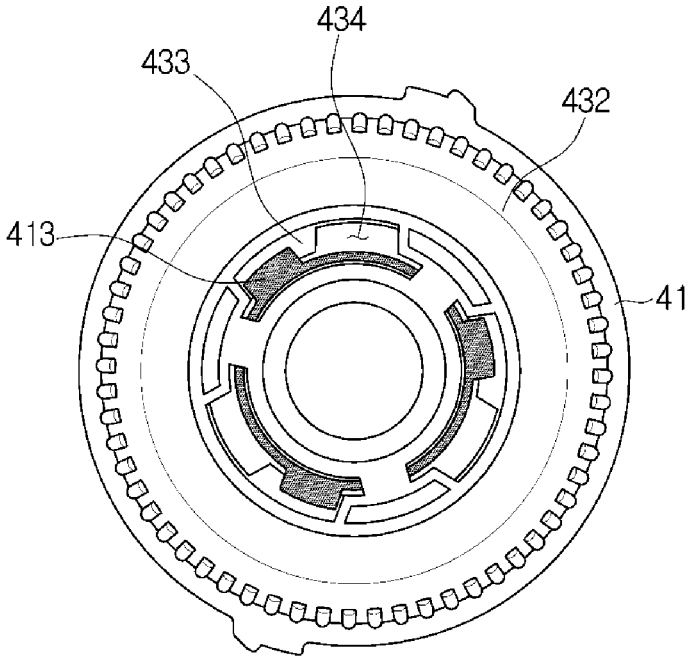

FIGS. 5A and 5B are views of a coupling portion between the grill assembly 43 and the case 41 in accordance with an embodiment of the present disclosure.

Referring to FIGS. 5A and 5B, the grill assembly 43 may be separably mounted on the case 41. When the grill assembly 43 is coupled with the case 41, the grill portion 430 may be accommodated in the case 41. When the grill assembly 43 is separated from the case 41, the grill portion 430 may get out of the case 41 through the second opening 412 formed in the case 41.

The coupling protrusion 413 may be provided on a bottom surface of the case 41. The handle portion 432 may include an insertion portion 434 into which the coupling protrusion 413 is inserted and an interfering portion 433 which disturbs the coupling protrusion 413.

The interfering portion 433 and the insertion portion 434 may be located corresponding to the coupling protrusion 413 formed on the case 41. When the second opening 412 is provided in a circular shape and the coupling protrusion 413 is provided protruding outside a circumference of the second opening 412, the insertion portion 434 and the interfering portion 433 may also be arranged along a shape of the circumference of the second opening 412 to correspond thereto.

When the plurality of coupling protrusions 413 are provided along the circumference of the second opening 412 while being spaced at predetermined intervals, the interfering portion 433 and the insertion portion 434 may also be provided in plural and may be alternately provided to correspond to the coupling protrusions 413.

After the coupling protrusion 413 formed on the case 41 is inserted through the insertion portion 434, when the grill assembly 43 rotates in one direction, the coupling protrusion 413 may be disturbed by the interfering portion 433 adjacent thereto. The coupling protrusion 413 is disturbed by the interfering portion 433, thereby mounting the grill assembly 43 on the case 41 to be locked.

To separate the grill assembly 43 from the case 41, the grill assembly 43 may be rotated in the other direction. The grill assembly 43 rotates in the other direction in such a way that the coupling protrusion 413 may be located in the insertion portion 434 and may be released from the lock state. The coupling protrusion 413 is allowed to get out through the insertion portion 434, thereby separating the grill assembly 43 from the case 41.

A configuration for coupling or separating the grill assembly 43 with or from the case 41 is not limited thereto.

Figure 6A:
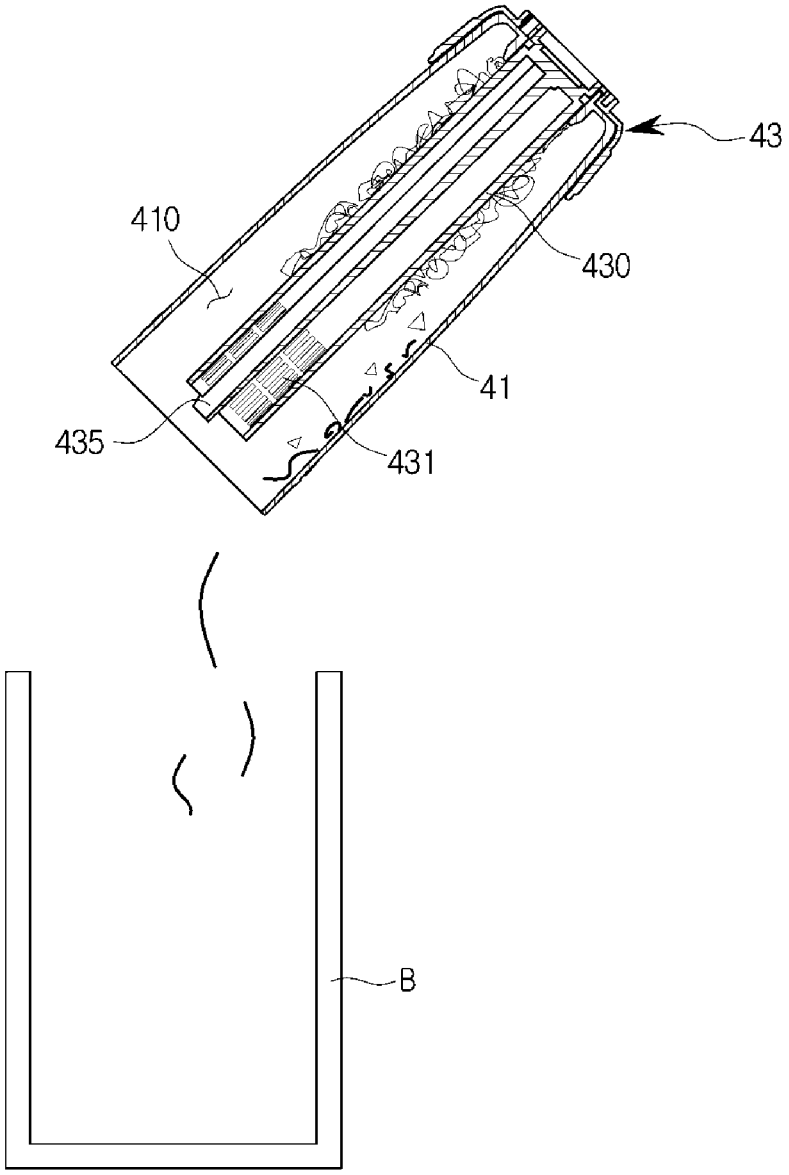
FIGS. 6A, 6B, and 6C are views illustrating foreign substances on a surface of a grill portion, which are separated in accordance with an embodiment of the present disclosure.
Figure 6B:
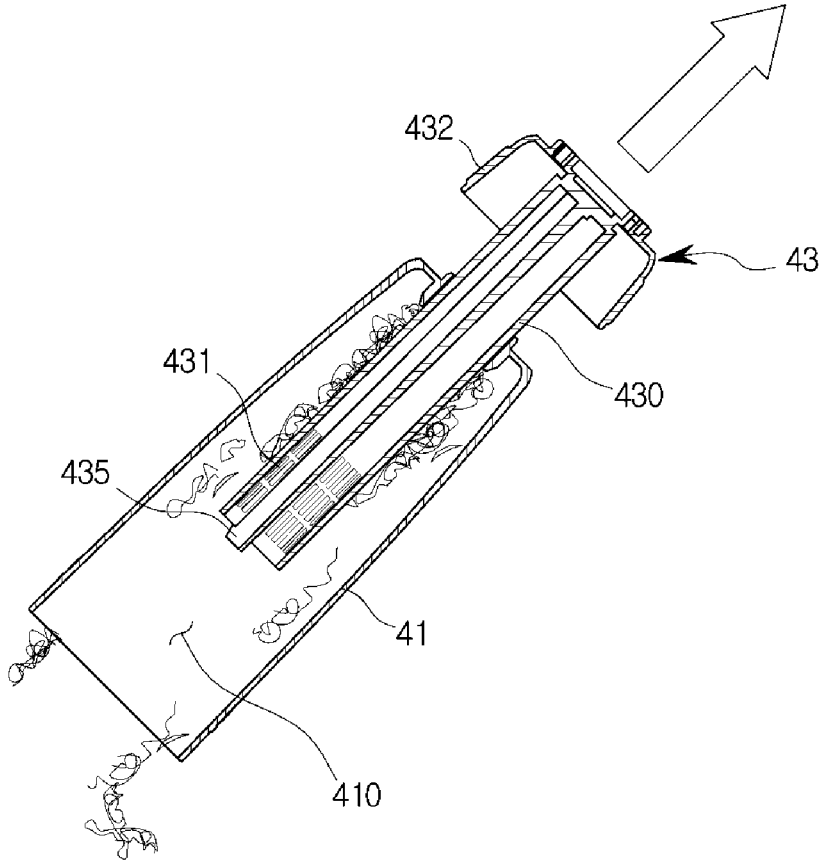
Figure 6B:
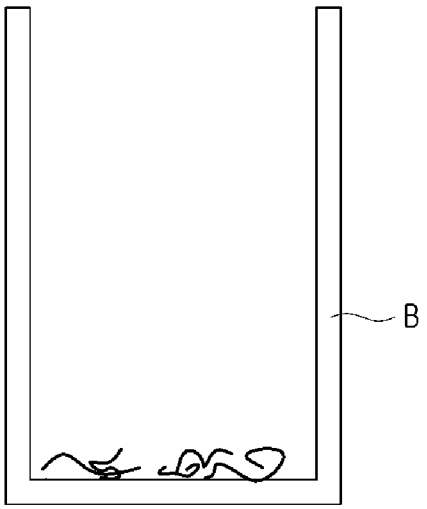
Figure 6C:
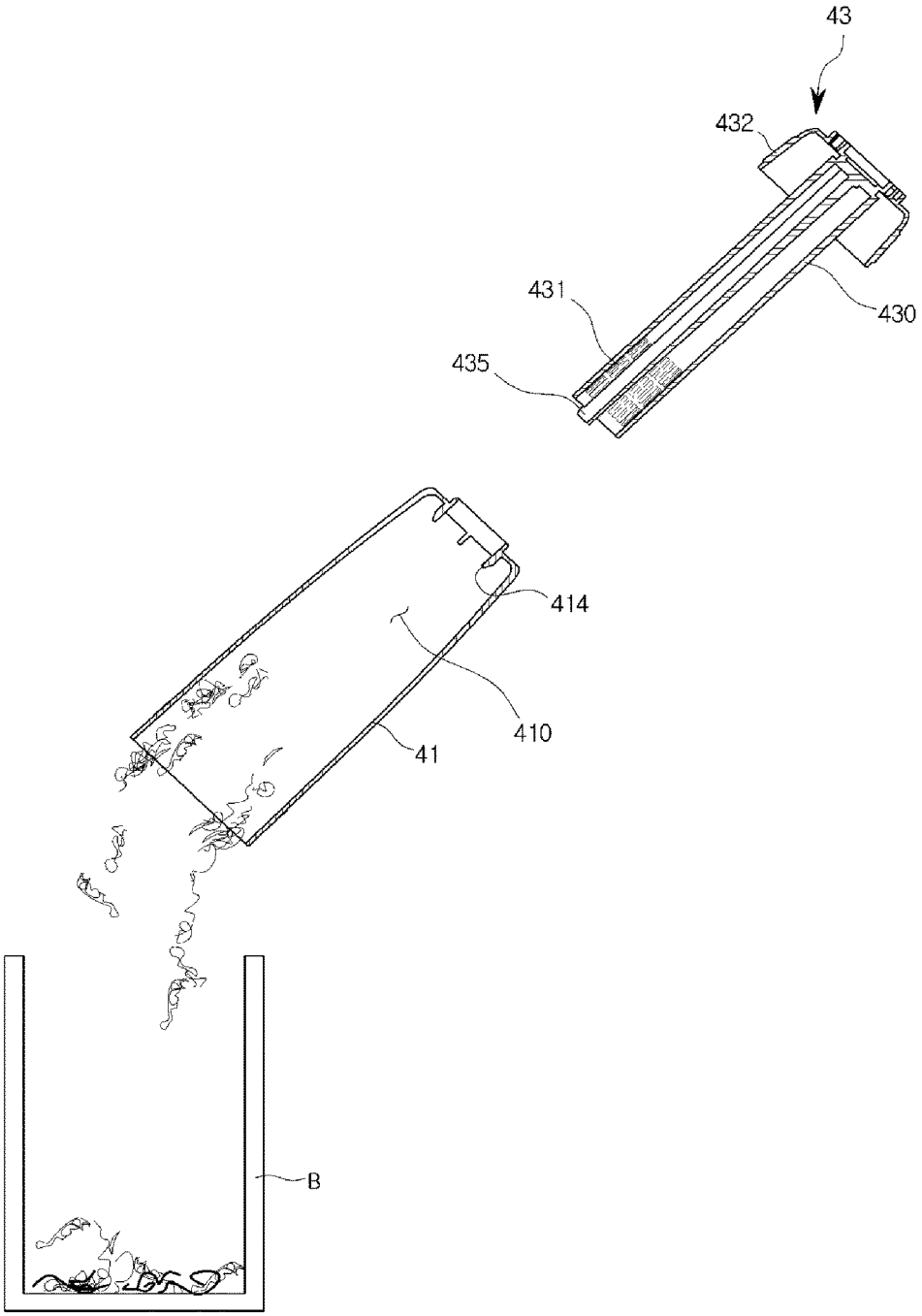
Figure 7:
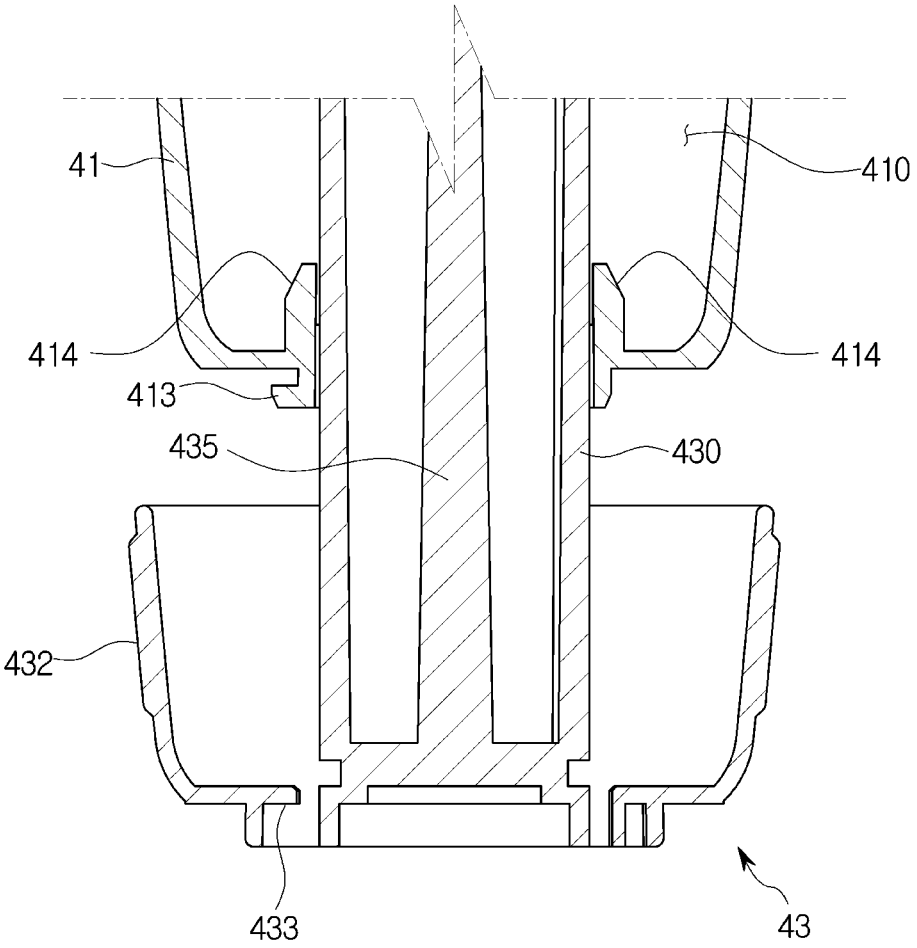
FIG. 7 is a view illustrating parts of the case and the grill assembly in accordance with an embodiment of the present disclosure.

FIGS. 6A to 6C are views illustrating foreign substances on the surface of the grill portion 430, which are separated in accordance with an embodiment of the present disclosure. FIG. 7 is a view illustrating parts of the case 41 and the grill assembly 43 in accordance with an embodiment of the present disclosure.

Referring to FIGS. 6A to 6C and 7, the grill assembly 43 in accordance with an embodiment of the present disclosure may be separably provided from the case 41. The grill assembly 43 may be configured to remove hairs, dust, etc. which stick to the surface of the grill portion 430 from the surface of the grill portion 430 as being separated from the case 41.

The hairs, dust, etc. removed from the surface of the grill portion 430 may be accommodated in the case 41. When emptying the case 41 to remove the dust therein, the user has only to throw away the dust accommodated in the case 41 into a trash bin B without removing the hairs, dust, etc. which stick to the surface of the grill portion 430 one by one by hand.

On the inner side surface of the case 41, the interfering protrusion 414 may be provided adjacently to the second opening 412. The interfering protrusion 414 may be configured to disturb the hairs, dust, etc. which stick to the surface of the grill portion 430 when the grill assembly 43 is separated from the case 41. Due to the interfering protrusion 414, the hairs, dust, etc. on the surface of the grill portion 430 may be removed from the surface of the grill portion 430. The dust and the like removed from the surface of the grill portion 430 may not get out of the second opening 412 and may be left in the case 41.

The interfering protrusion 414 may be configured to be in contact with the surface of the grill portion 430. Even when being provided not to be in contact with the surface of the grill portion 430, the interfering protrusion 414 may be provided closely to the grill portion 430 to disturb the hairs, dust, etc. on the surface of the grill portion 430. Also, the interfering protrusion 414 may not be provided and dust which sticks to the surface of the grill portion 430 may be removed by an inner side surface of the second opening 412.

Hereinafter, an example in which the dust which sticks to the surface of the grill portion 430 is removed by the interfering protrusion 414 will be described.

A spiral air current may be formed in the cyclone chamber 410, and air separated from dust due to the spiral air current may pass through the air through holes 431 formed in the grill portion 430. The air which passes through the air through holes 431 may be discharged outside the cyclone dust collector 40 through the outlet portion 425.

In the case 41, hairs, dust, etc. separated by the spiral air current may be collected. The user may separate the cyclone dust collector 40 from the extension pipe 20 and the handle pipe 30, may open the cover 42, and then may empty the case 41 to remove the dust therein.

Here, hairs or dust may stick to the surface of the grill portion 430. In a conventional case, the user has to remove the hairs or dust which stick to the surface of the grill portion 430 by hand. While the hairs or dust which stick to the surface of the grill portion 430 are removed, the removed dust may not be inserted into the trash bin B but may scatter around the trash bin B, which is a secondary contamination. Also, removing the hairs, dust, etc. by hand is unsanitary.

In the case of the embodiment of the present disclosure, the grill portion 430 is separably provided from the case 41. Also, when the grill portion 430 is separated from the case 41, the hairs, dust, etc. which stick to the surface of the grill portion 430 are disturbed by the interfering protrusion 414 to be removed from the surface of the grill portion 430.

The user may clean the surface of the grill portion 430 only using an operation of separating the grill portion 430 from the case 41 without picking the hairs, dust, etc. which stick to the surface of the grill portion 430 by hand. The user has only to empty the case 41 in which the dust removed from the surface of the grill portion 430 is accommodated.

To empty the case 41 to remove foreign substances therein, the user may allow the first opening 411 of the case 41 to head for the trash bin B and then may separate the grill assembly 43 from the case 41. The dust removed from the surface of the grill portion 430 may be thrown away to the trash bin B together with the dust collected in the case 41.

As described above, because the grill assembly 43 of the cyclone dust collector 40 is separably provided, it is possible to prevent the occurrence of the secondary contamination around the bin B while the dust on the surface of the grill portion 430 is being removed. Also, because the user does not have to pick dust, etc. by hand, it is sanitary.

Figure 8:
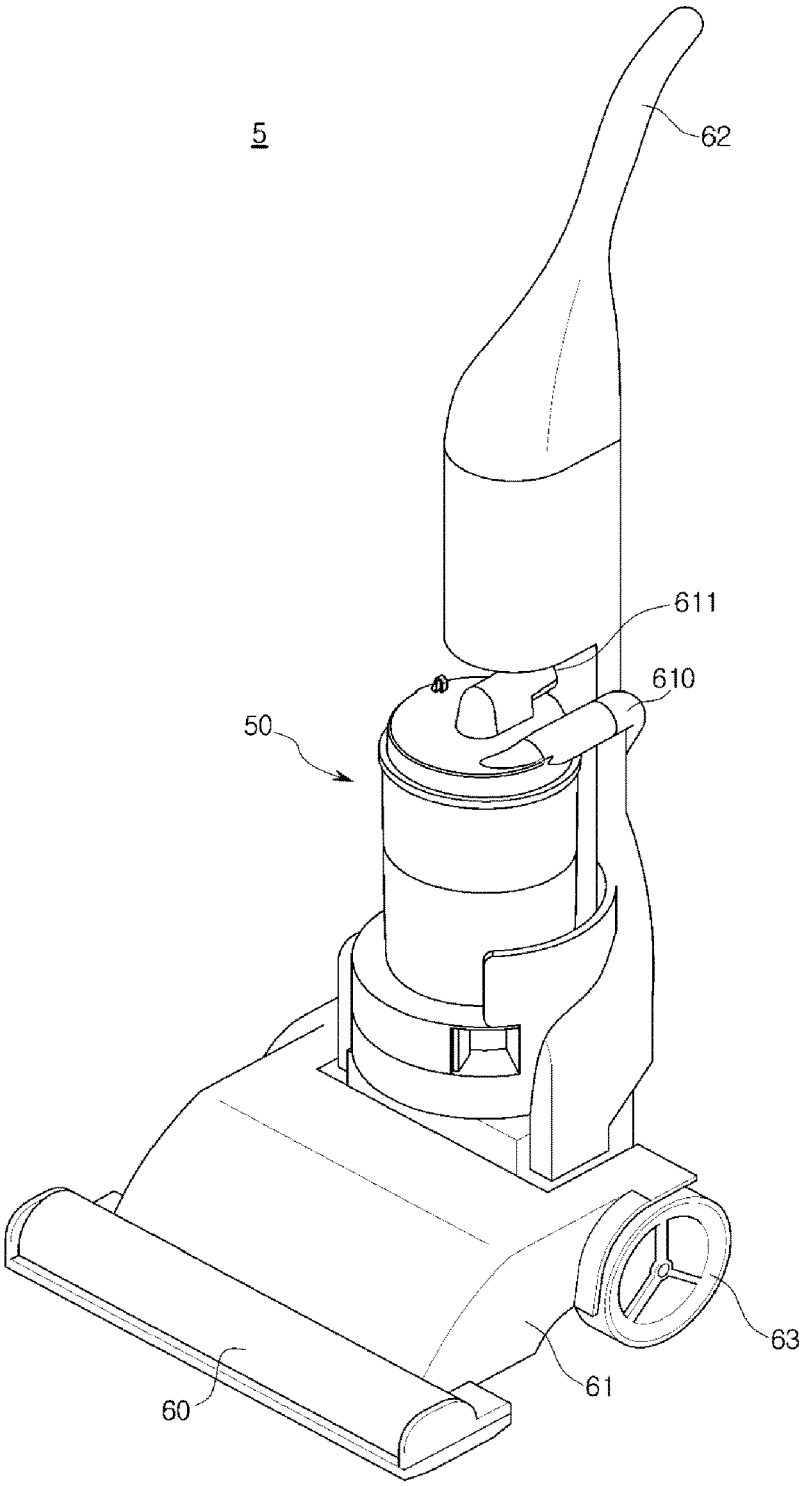
FIG. 8 is a perspective view of a vacuum cleaner in accordance with an embodiment of the present disclosure.

FIG. 8 is a perspective view of a vacuum cleaner 5 in accordance with an embodiment of the present disclosure.

Referring to FIG. 8, the vacuum cleaner 5 in accordance with an embodiment of the present disclosure is an upright type vacuum cleaner and may include a suction portion 60 which is in contact with a cleaning-target surface and suctions air, a body 61 which generates suction force, and a cyclone dust collector 50 mounted on the body 61. The suction portion 60 may be directly connected to the body 61 without an additional hose intervening therebetween. A handle portion 62 operable by a user may be provided above the body 61.

A fan motor (not shown) which generates the suction force may be provided in the body 61. Wheels 63 for moving the body 61 may be provided below the body 61. A suction brush (not shown) may be provided in the suction portion 60 to easily clean carpet, etc.

The cyclone dust collector 50 may be separably mounted on the body 61. The air sucked through the suction portion 60 flows into the cyclone dust collector 50 through a suction port 610. The cyclone dust collector 50 may separate and collect dust using a spiral air current. The dust may be filtered inside the cyclone dust collector 50 and then may be discharged through a discharge port 611. The user may separate the cyclone dust collector 50 from the body 61 and may empty the cyclone dust collector 50 to remove the collected dust.

The cyclone dust collector 40 shown in FIGS. 1 to 7 is applied to a canister type cleaner, and the cyclone dust collector 50 shown in FIGS. 8 to 11C is applied to an upright type cleaner. However, configurations of grill assemblies of the cyclone dust collectors 40 and 50 may be similar to each other. Hereinafter, the upright type vacuum cleaner 5 and the cyclone dust collector 50 applied thereto shown in FIGS. 8 to 11C will be described in detail with reference to the drawings.

Figure 9:
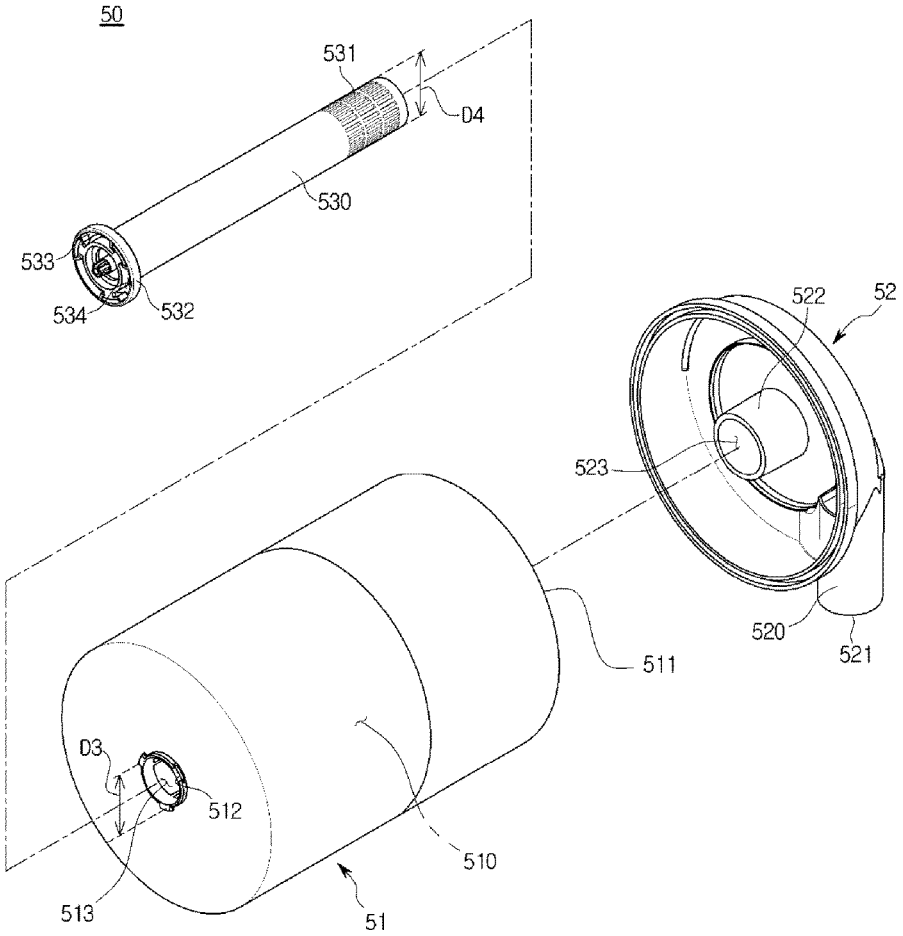
FIG. 9 is an exploded view of a case and a grill assembly of a cyclone dust collector in accordance with an embodiment of the present disclosure.
Figure 10:
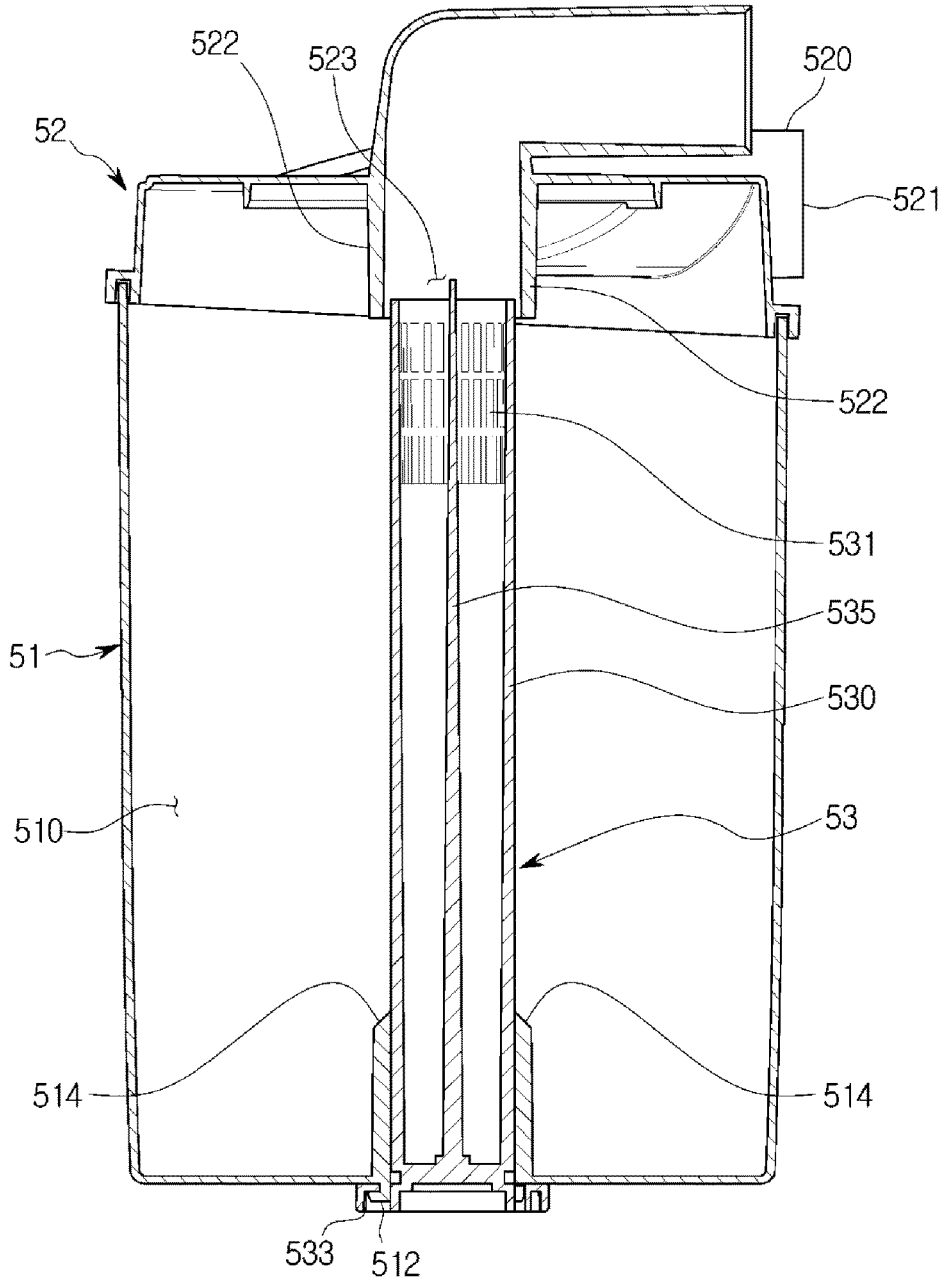
FIG. 10 is a cross-sectional view of the cyclone dust collector in accordance with an embodiment of the present disclosure.

FIG. 9 is an exploded view of a case 51 and a grill assembly 53 of the cyclone dust collector 50 in accordance with an embodiment of the present disclosure. FIG. 10 is a cross-sectional view of the cyclone dust collector 50 in accordance with an embodiment of the present disclosure.

Referring to FIGS. 9 and 10, the cyclone dust collector 50 in accordance with an embodiment of the present disclosure may include the case 51, a cover 52, and the grill assembly 53. The cover 52 may be mounted on one side of the case 51. The grill assembly 53 may be separably mounted on the other side of the case 51.

The case 51 may include a cyclone chamber 510 to allow air which flows therein to circle to separate dust therefrom. The case 51 may be provided in a cylindrical shape. A first opening 511 connected to the cover 52 may be formed in the one side of the case 51, and a second opening 513 may be formed in the other side of the case 51 to allow at least a part of the grill assembly 53 to be inserted thereinto.

The cover 52 may be provided to cover the first opening 511 formed in the case 51. The cover 52 may include an inflow pipe 520 connected to the suction port 610 to allow the suctioned air to flow into the cyclone chamber 510. The cover 52 may include a discharge pipe 522 communicated with the discharge port 611 to allow the air filtered with the dust in the cyclone chamber 510 to be discharged.

The grill assembly 53 may include a grill portion 530 having air through holes 531 formed therein. The grill portion 530 may be provided in a cylindrical shape. To allow the grill portion 530 to be inserted into the case 51 through the second opening 513, outer surfaces of the second opening 513 and the grill portion 530 may be provided to correspond to each other.

For example, the second opening 513 may be provided in a cylindrical shape. A diameter D3 of the second opening 513 may be identical to or slightly greater than a diameter D4 of the grill portion 530. The shape of the second opening 513 is not limited thereto.

A handle portion 532 may be provided on one side of the grill portion 530. When the grill assembly 53 is mounted on the case 51, the handle portion 532 may be located outside the case 51 to allow the user to operate the assembly.

To hold the grill portion 530 when the fan motor generates the suction force, a supporting rib 535 which extends in an extension direction of the grill portion 530 may be provided inside the grill portion 530. One end of the supporting rib 535 may be fixed to the handle portion 532, and the other end may be fixed to the cover 52.

A coupling protrusion 512 may be provided around the second opening 513 to allow the grill assembly 53 to be coupled therewith. The coupling protrusion 512 may protrude outside the case 51.

The coupling protrusion 512 may be inserted into an insertion portion 534 formed in the handle portion 532. When the coupling protrusion 512 is inserted into the insertion portion 534 and the handle portion 532 rotates in one direction, the coupling protrusion 512 may be stopped by an interfering portion 533 adjacent to the insertion portion 534. Hereby, the grill assembly 53 may be mounted on the case 51. A state in which the coupling protrusion 512 is stopped by the interfering portion 533 may be referred to as a lock state.

The user may rotate the handle portion 532 in the other direction to allow the coupling protrusion 512 to be located in the insertion portion 534 to release the lock state and then may separate the grill assembly 53 from the case 51. A structure in which the grill assembly 53 is mounted on the case 51 is not limited thereto.

The air sucked through the suction portion 60 may flow into the cyclone chamber 510 through the suction port 610 and an inlet 521 provided in the inflow pipe 520. Inside the cyclone chamber 510, dust and the like may be separated and collected due to the spiral air current. The air separated from the dust and the like inside the cyclone chamber 510 may pass through the air through holes 531 of the grill portion 530 and may be discharged outward through a discharge portion 523 provided in the discharge pipe 522 and the discharge port 611.

Because the cyclone dust collector 50 is separably mounted on the body 61, the user may separate the cyclone dust collector 50 from the body 61 and may empty the cyclone chamber 510 to remove the dust collected therein.

Figure 11A:
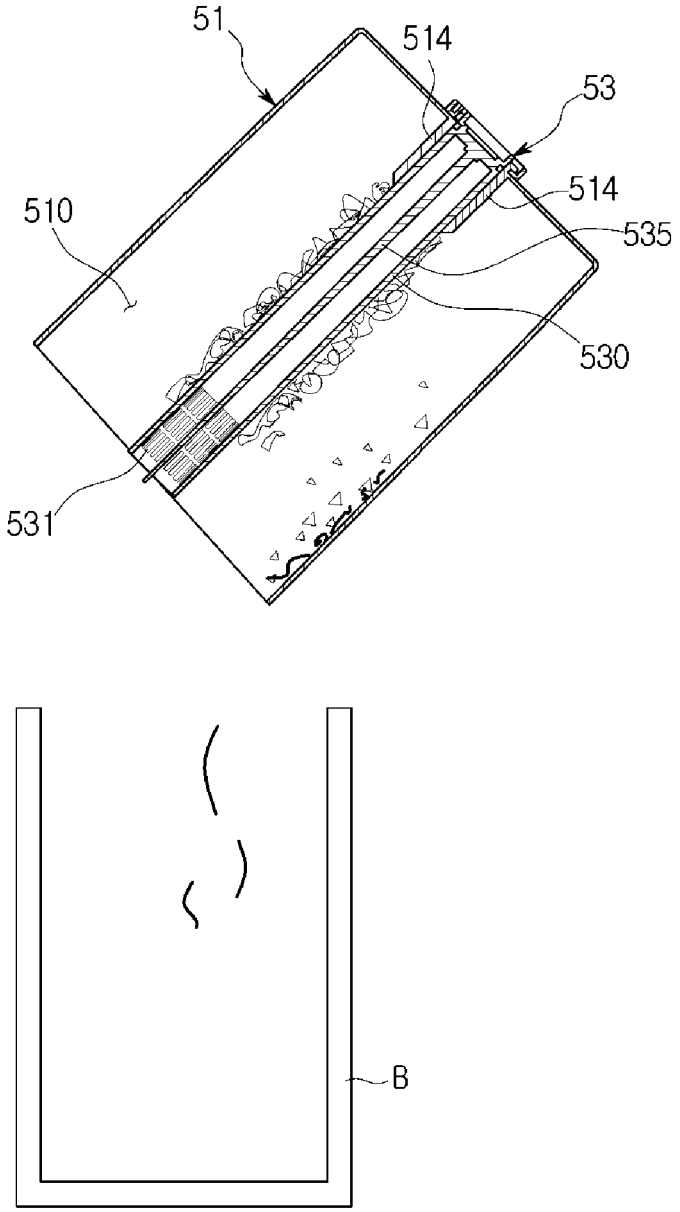
FIGS. 11A, 11B, and 11C are views illustrating a process in which foreign substances on a surface of a grill portion are separated in accordance with an embodiment of the present disclosure.
Figure 11B:
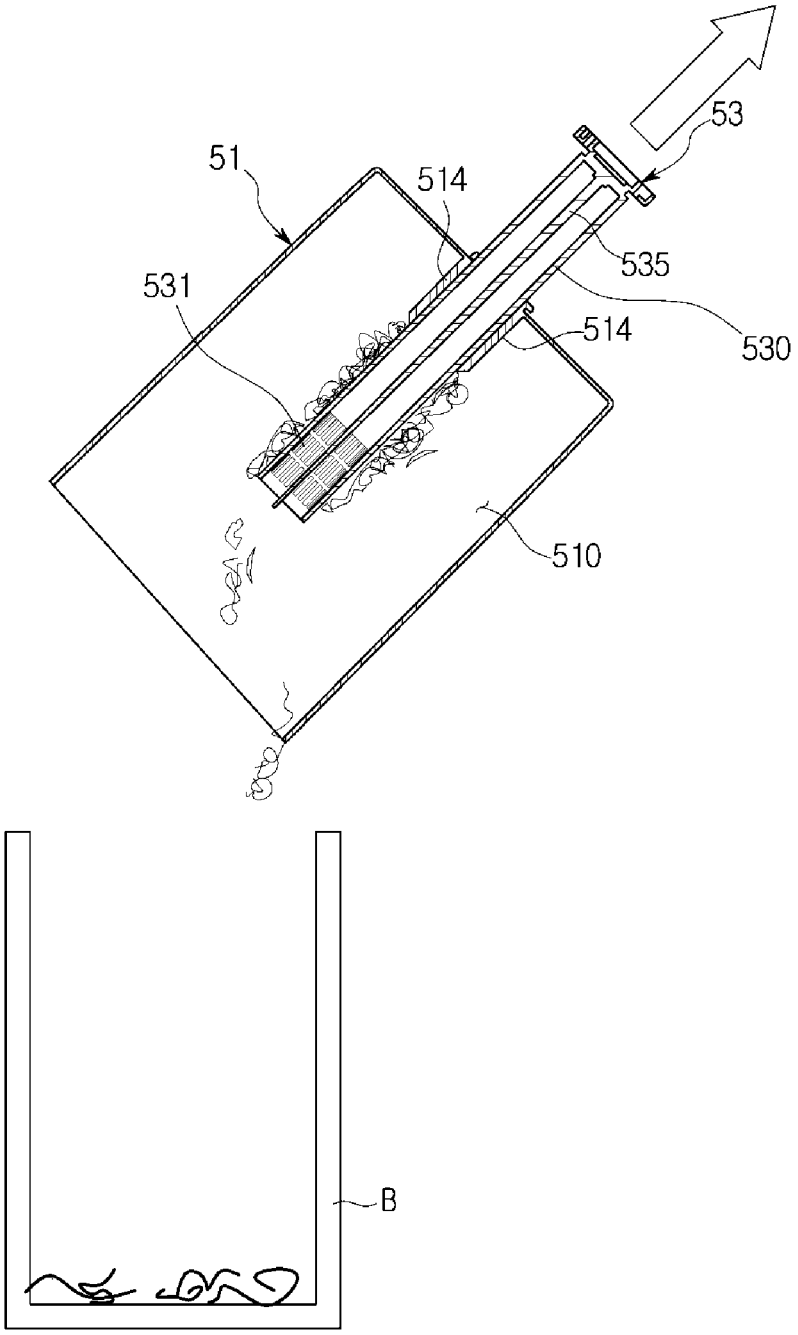
Figure 11C:
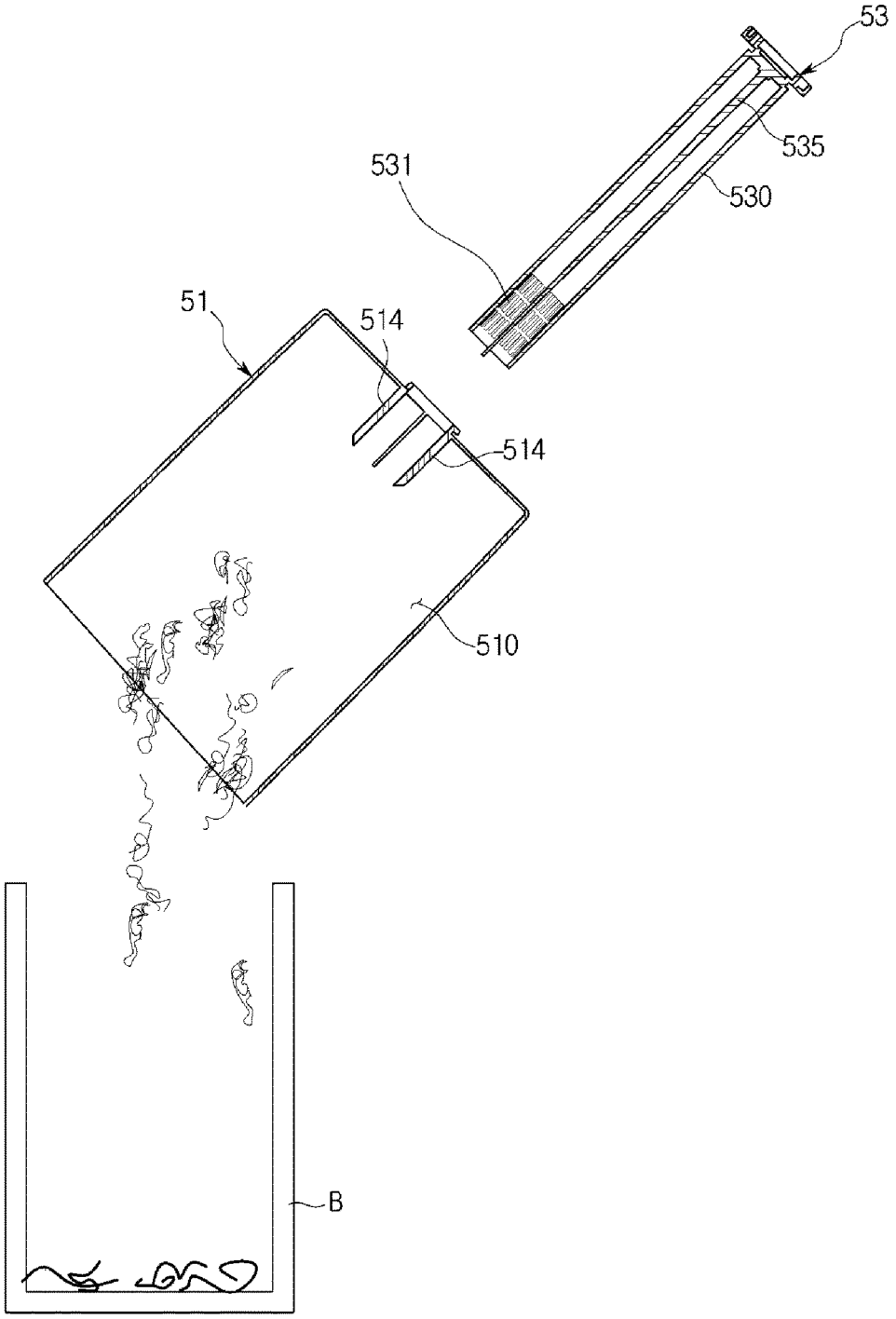

FIGS. 11A to 11C are views illustrating a process in which foreign substances on a surface of the grill portion 530 are separated in accordance with an embodiment of the present disclosure.

Referring to FIGS. 11A to 11C, dust, hairs, etc. which stick to the surface of the grill portion 530 may be removed by an operation of separating the grill assembly 53 of the cyclone dust collector 50 in accordance with an embodiment of the present disclosure from the case 51. The user may separate the cyclone dust collector 50 from the body 61, may open the cover 52, and then may empty the cyclone chamber 510 to remove the dust and the like collected therein. Here, the hairs, dust, etc. may stick to the surface of the grill portion 530 and may not be separated.

The user may remove the dust which sticks to the surface of the grill portion 530 by separating the grill assembly 53 from the case 51. The user may release the lock state by rotating the grill assembly 53 and then may separate the grill assembly 53 from the case 51. While the grill assembly 53 is being separated from the case 51, the dust and the like which sticks to the grill portion 530 may be disturbed by an interfering protrusion 514 provided on an inner side surface of the case 51. The dust and the like which sticks to the surface of the grill portion 530 is disturbed by and removed by the interfering protrusion 514 and left in the case 51. The user has only to empty the case 51 to throw away the dust removed from the surface of the grill portion 530 and accommodated in the case 51 into the trash bin B without picking the dust and the like which sticks to the surface of the grill portion 530 by hand.

Meanwhile, the interfering protrusion 514 may be provided to be in contact with the surface of the grill portion 530 or may be located adjacently to the second opening 513 to disturb the dust and the like which sticks to the surface of the grill portion 530 even though not in contact with the surface of the grill portion 530.

As described above, because the dust and the like which sticks to the surface of the grill portion 530 may be removed by simply separating the grill assembly 53 from the case 51, it is not necessary for the user to remove hairs, dust, etc. which stick to the surface of the grill portion 530 by hand. Accordingly, the cyclone dust collector may be sanitarily managed. Also, it is possible to prevent the occurrence of secondary contamination while removing the dust and the like which sticks to the surface of the grill portion 530.

As is apparent from the above description, a vacuum cleaner in accordance with an embodiment of the present disclosure is easily emptied by a user without removing dust and the like which sticks to an outer circumferential surface of a grill portion by hand.

Also, it is possible to prevent the occurrence of secondary contamination around a case when removing dust which sticks to the outer circumferential surface of the grill portion.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A vacuum cleaner comprising:

a cyclone dust collector including:

a case in which debris is separated from air and collected;

a cover coupled with a first side of the case;

a grill assembly separably mountable on a second side of the case and including a grill portion configured to be accommodated in the case; and a cleaning portion including an interfering protrusion, the interfering protrusion configured to clean debris from a surface of the grill assembly as the grill assembly is separated from the case so that the debris from the surface of the grill assembly is collected in the case, wherein the grill portion is configured to extend from a bottom surface of the case to the cover.

2. The vacuum cleaner of claim 1, wherein the interfering protrusion includes a portion that narrows towards the interior of the case.

3. The vacuum cleaner of claim 1, wherein the cleaning portion is configured to contact the surface of the grill assembly.

4. The vacuum cleaner of claim 1, wherein the cleaning portion is integrally provided with the case.

5. The vacuum cleaner of claim 1, wherein the case comprises an opening in one side of the case, and the grill assembly is configured to be insertable into the case through the opening.

6. The vacuum cleaner of claim 5, wherein the cleaning portion is provided on an inner wall of the case in which the opening is formed.

7. The vacuum cleaner of claim 5, wherein a diameter of the opening is substantially identical to a diameter of the grill assembly inserted into the case.

8. The vacuum cleaner of claim 7, wherein the interfering protrusion protrudes from an inner wall of the case.

9. The vacuum cleaner of claim 1, wherein the grill assembly further comprises:

a handle portion provided on one side of the grill portion, wherein the grill portion includes holes formed therein for air to pass therethrough.

10. The vacuum cleaner of claim 9, wherein the grill portion comprises a supporting rib configured therein to support the grill portion.

11. The vacuum cleaner of claim 9, wherein the case comprises a coupling protrusion on an outer surface thereof.

12. The vacuum cleaner of claim 11, wherein the handle portion comprises an interfering portion configured to interfere with the coupling protrusion.

13. The vacuum cleaner of claim 12, wherein the handle portion comprises an insertion hole into which the coupling protrusion is insertable.

14. The vacuum cleaner of claim 13, wherein when the interfering portion is inserted into the insertion hole and the handle portion is rotated in one direction, the coupling protrusion is stopped by the interfering portion and the handle portion is fixed to the case.

15. The vacuum cleaner of claim 9, wherein the handle portion comprises an uneven portion on a surface thereof.

16. The vacuum cleaner of claim 15, wherein the grill portion and the handle portion are integrally injection-molded.

17. A cyclone dust collector comprising:

a case in which debris is separated from air and collected, and including a cleaning portion including an interfering protrusion protruding in a direction towards an interior of the case; and a grill portion separably mountable on the case, wherein debris on a surface of the grill portion is removed by the interfering protrusion when the grill portion is separated from the case, wherein the case comprises a cover which is mounted thereon and comprises:

an inlet portion configured to allow the sucked air to flow into the case; and an outlet portion configured to allow air separated from the debris to be discharged from the case, and wherein the grill portion is configured to extend from a bottom surface of the case to the cover.

18. The cyclone dust collector of claim 17, wherein the interfering protrusion includes a portion that narrows towards the interior of the case.

19. The cyclone dust collector of claim 18, wherein the cleaning portion removes the debris from the surface of the grill portion such that the debris remains in the case.

20. The cyclone dust collector of claim 18, wherein the cleaning portion is integrally formed together with the case.

21. The cyclone dust collector of claim 18, wherein the case comprises an opening to allow the grill portion to pass therethrough.

22. The cyclone dust collector of claim 21, wherein the cleaning portion is provided on an inner side surface of the case in which the opening is formed.

23. The cyclone dust collector of claim 21, wherein a diameter of the opening is substantially identical to a diameter of the grill portion.

24. The cyclone dust collector of claim 17, wherein the grill portion comprises a handle portion on one side thereof.

25. The cyclone dust collector of claim 17, wherein the cover is configured to be openable.

26. A cyclone dust collector comprising:

a case which separates debris from air which flows in through an inlet portion by allowing the air to circulate in the case;

a cover coupled with a first side of the case;

an outlet portion configured to allow the air separated from the debris to be discharged from the case;

a grill assembly connected to the outlet portion and separably mountable on a second side of the case which is opposite to the first side; and a cleaner which removes debris from a surface of the grill assembly while the grill assembly is being separated from the case, wherein the grill assembly includes a grill portion configured to extend from a bottom surface of the case to the cover.

27. The cyclone dust collector of claim 26, wherein the case comprises an opening to allow the grill assembly to pass therethrough.

28. The cyclone dust collector of claim 27, wherein the cleaner includes an cleaner is formed on an inner side surface of the case in which the opening is formed.

29. The cyclone dust collector of claim 26, wherein the interfering protrusion which includes a portion that narrows towards the interior of the case.

* * * * *